US008915020B2

(12) United States Patent
Sauter

(10) Patent No.: US 8,915,020 B2
(45) Date of Patent: Dec. 23, 2014

(54) DEVICE FOR SEALINGLY CLOSING A ROOM OPENING

(75) Inventor: Heinz Sauter, St. Gallen (CH)

(73) Assignee: air-lux technik ag, Engelburg (CH)

( * ) Notice: Subject to any disclaimer, the term of this patent is extended or adjusted under 35 U.S.C. 154(b) by 231 days.

(21) Appl. No.: 12/773,074

(22) Filed: May 4, 2010

(65) Prior Publication Data

US 2011/0107674 A1 May 12, 2011

Related U.S. Application Data

(60) Provisional application No. 61/175,071, filed on May 4, 2009.

(51) Int. Cl.
*E06B 7/18* (2006.01)
*E06B 7/23* (2006.01)

(52) U.S. Cl.
CPC ..... *E06B 7/2318* (2013.01)
USPC ..... 49/477.1; 49/489.1; 49/475.1; 187/400; 277/605; 277/645

(58) Field of Classification Search
CPC ..... E06B 7/2318; E06B 7/22; E06B 7/2303; E06B 7/2309; E06B 7/16; B60J 10/0037
USPC ..... 49/477.1, 489.1, 360, 475.1, 411; 277/605, 645
See application file for complete search history.

(56) References Cited

U.S. PATENT DOCUMENTS

| | | | | | |
|---|---|---|---|---|---|
| 2,848,782 | A | * | 8/1958 | Gillison | 27/17 |
| 3,352,446 | A | * | 11/1967 | Anderson et al. | 220/232 |
| 3,518,355 | A | * | 6/1970 | Luce | 174/365 |
| 3,769,750 | A | * | 11/1973 | Mayer et al. | 49/477.1 |
| 3,984,942 | A | * | 10/1976 | Schroth | 49/477.1 |
| 4,177,353 | A | * | 12/1979 | McCormack | 174/374 |
| 4,370,831 | A | * | 2/1983 | Hamilton | 49/477.1 |
| 4,372,084 | A | * | 2/1983 | Janke | 49/477.1 |
| 4,579,192 | A | * | 4/1986 | Mueller | 277/312 |
| 4,706,413 | A | * | 11/1987 | James | 49/477.1 |
| 5,039,826 | A | * | 8/1991 | Newland | 174/374 |
| 5,079,873 | A | * | 1/1992 | Smith | 49/477.1 |
| 5,294,757 | A | * | 3/1994 | Skalski et al. | 187/393 |
| 6,195,941 | B1 | * | 3/2001 | Burow et al. | 49/477.1 |
| 6,918,210 | B1 | * | 7/2005 | Smiley | 49/360 |

(Continued)

FOREIGN PATENT DOCUMENTS

| | | |
|---|---|---|
| EP | 1936295 | 6/2008 |
| GB | 499019 | 1/1939 |
| GB | 1258563 | 12/1971 |
| GB | 2161430 | 1/1986 |
| GB | 2324112 | 10/1998 |

*Primary Examiner* — Katherine Mitchell
*Assistant Examiner* — Marcus Menezes
(74) *Attorney, Agent, or Firm* — Shoemaker and Mattare

(57) ABSTRACT

A device (100) for closing an opening in a room has a frame (102) in the reveal of the room opening and at least one leaf (104) which is arranged movably with respect to the frame (102) and is movable with respect to the frame into a closure position in which there is, between the frame (102) and the leaf (104), a gap (112) which can be sealed by means of a deformable and/or movable sealing member (114). A sealing member actuating device (120), by means of which the sealing member (114) can be deformed and/or moved, is arranged in the frame (102) and/or in the leaf (104) in order to seal the gap (112).

10 Claims, 6 Drawing Sheets

(56) References Cited

U.S. PATENT DOCUMENTS

2005/0060937 A1* 3/2005 Dondlinger et al. ..... 49/118
2006/0196361 A1* 9/2006 Henderson et al. ..... 96/148
2007/0170663 A1* 7/2007 Kuipers et al. ..... 277/645
2007/0175097 A1* 8/2007 Thorne et al. ..... 49/169
2007/0251147 A1* 11/2007 Box ..... 49/21

* cited by examiner

DEVICE FOR SEALINGLY CLOSING A ROOM OPENING

CROSS REFERENCE TO RELATED APPLICATIONS

This application claims the benefit of U.S. Provisional Application No. 61/175,071, filed May 4, 2009, the content of which is incorporated by reference herein,

COPYRIGHT & LEGAL NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. Further, no references to third party patents or articles made herein is to be construed as an admission that the present invention is not entitled to antedate such material by virtue of prior invention.

BACKGROUND OF THE INVENTION

The invention relates to a device for closing a room opening. Such a device comprises a frame in the reveal of the room opening and at least one leaf which is movably arranged relative to the frame and can move relative to the frame into a closed position. In this closed position, there exists between the frame and the leaf a gap which can be sealed off by means of a deformable and/or movable sealing member.

Such a device is known from EP 1 936 295 A2, the content of which is incorporated by reference hereto and relied upon. In the known devices of this type, the sealing member is pneumatically actuated. The compressed air source is in this case located outside the device. If a number of these devices are provided in a building, the respective sealing members are actuated by compressed air from a central compressed air source. During the installation of such devices, this requires additional complexity in respect of installing pneumatic lines in the building.

SUMMARY OF THE INVENTION

A device for closing a room opening includes a frame, at least one leaf, a deformable and/or moveable sealing member and a sealing member actuation device. The frame is adapted to be set in a reveal of a room opening, the leaf being movably arranged relative to the frame so as to move relative to the frame from an open to a closed position in which there nonetheless exists between the frame and the leaf a gap. The sealing member is disposed at least substantially within the gap. The sealing member, when not pressurized, does not drag against an adjacent component of the device which is moving relative thereto when the room opening is opened or closed. The sealing member is actuated by the actuation device when the device is in a position suitable for actuation of the sealing member so as to better ensure that the sealing member does not drag against the adjacent component until desired. The sealing member actuation device is arranged in the frame and/or in the leaf, thereby permitting a "plug-and-play" installation of the device without need for a pre-existing fluid pressure source.

An object of the invention is to provide fluid-assisted sealing of a glazing system whereby no frictional resistance whatsoever is generated by the sealing system itself when an opening sealed therewith is being opened and shut and which is 100% weatherproof (i.e., an air and water-tight seal is generated) once activated.

Further advantages, features and possible uses will emerge from the following description of a non-limiting example of embodiment with reference to the drawing, in which:

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT

The following description is not intended to limit the scope of the invention in any way as they are exemplary in nature and serve to describe the best mode of the invention known the inventors as of the filing date hereof. Consequently, changes may be made in the arrangement and/or function of any of the elements described in the disclosed exemplary embodiments without departing from the spirit and scope of the invention.

Figure 1:
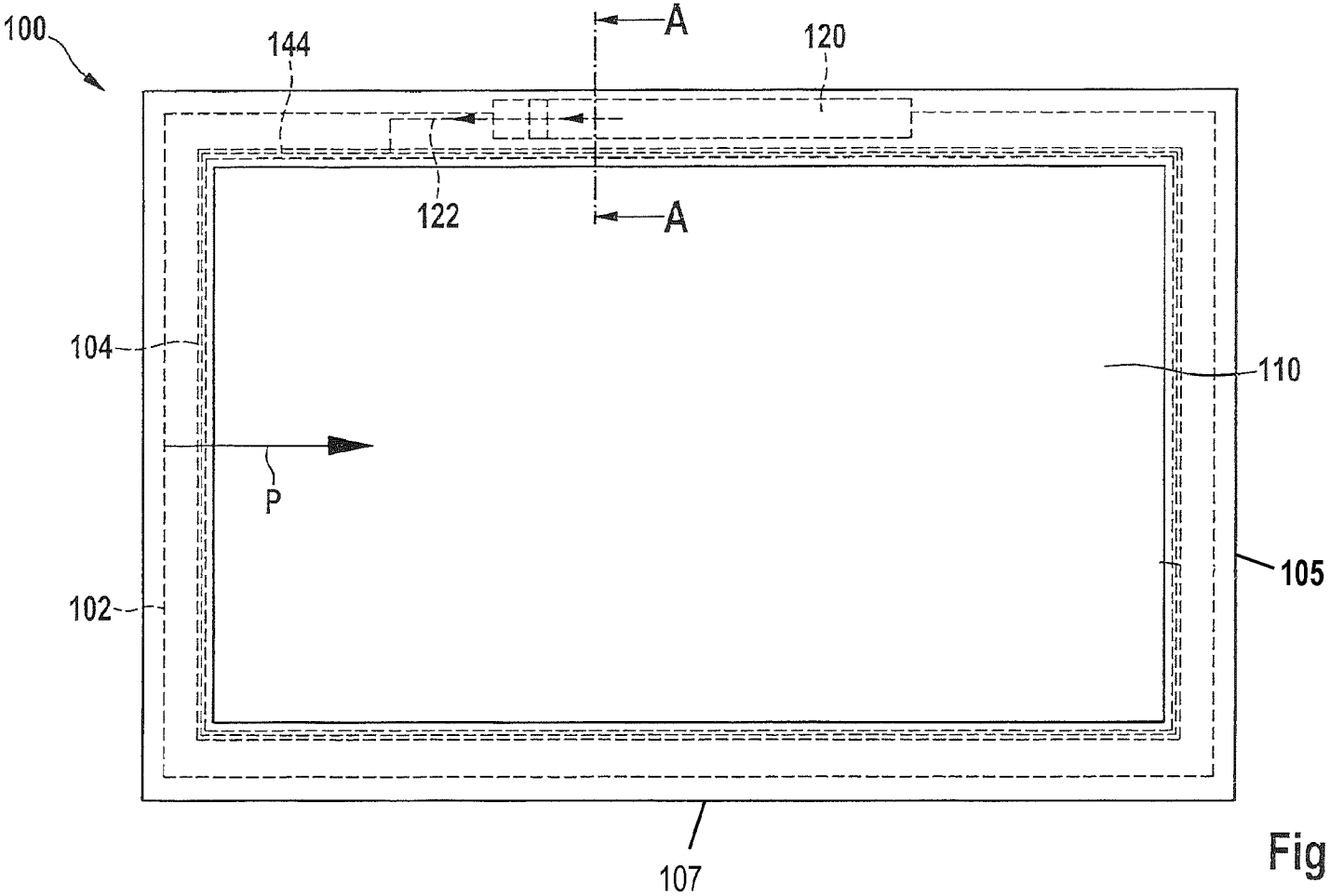
FIG. 1 schematically shows a device according to the invention with a frame and a leaf which is slidable relative thereto, in a first embodiment.

Referring now to FIG. 1, a device 100 according to the invention includes a frame 102 and a leaf 110. The leaf 110 is slidable relative to the frame 102. Both the frame 102 and the leaf 104 in each case have two vertical legs 105 and two horizontal legs 107, which are in each case connected to one another usually at right angles in the corners of the frame 102 and of the leaf 104. A glass pane 106 and 110 is respectively inserted in the frame 102 and in the leaf 104. The leaf 104 is arranged parallel to the frame 102 and is slidable parallel to the latter, as indicated by the arrow P. To this end, sliding rails, rollers 103 (shown in FIG. 5A) and the like are provided. As shown in FIG. 1, the leaf 104 is in the closed position, in which the room opening, i.e. the frame 102, is practically completely covered by the leaf 104.

The frame 102 is intended to be inserted in a reveal in a wall, which delimits a room opening such as e.g. a window or a door in a wall. A plurality of such frames 102 can also be connected to one another without a brick-build or concrete or other such wall, so that the plurality of frames 102 form the actual wall structure.

Arranged in the frame 102 is a sealing member 114 which extends along the entire frame. This sealing member 114 has the shape of a hollow profile or a tube made from an elastomer material. It is inserted in a rigid cutout 116 (see FIG. 3) of the frame 102 which is shaped in a manner complementary to the cross-sectional shape (sealing profile) of the sealing member 114. A sealing member actuation device 120 in the form of a compressed air source is arranged in the upper horizontal leg of the frame 102. This compressed air source 120 is connected to the sealing member 114 via a pressure line 122 which runs in the interior of the frame 102.

Figure 2:
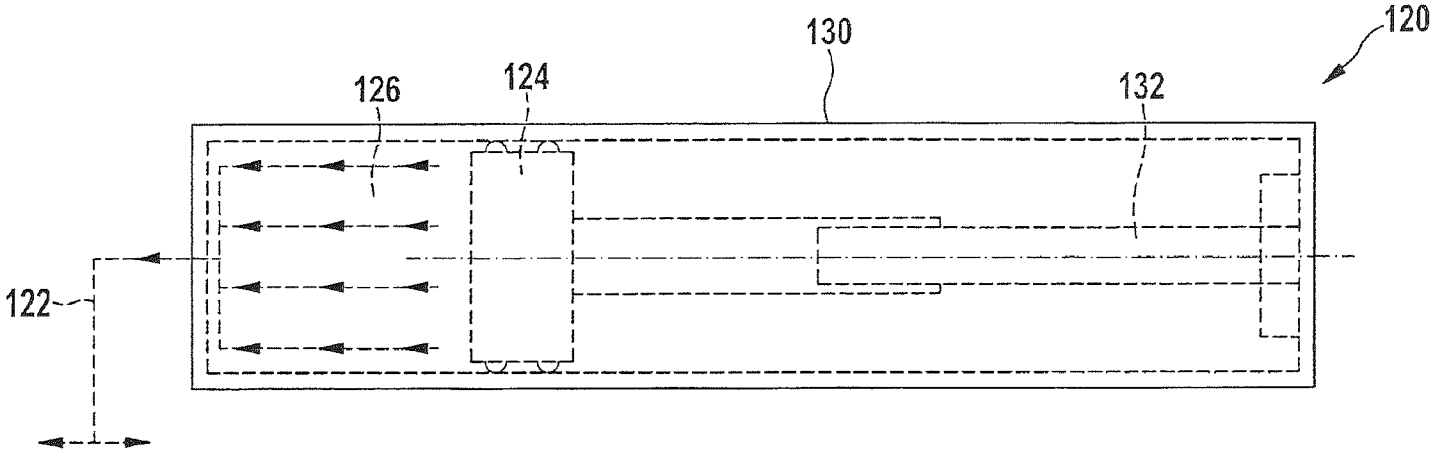
FIG. 2 schematically shows part of FIG. 1 on an enlarged scale and with further details.

Referring now to FIG. 2, which schematically shows part of FIG. 1 on an enlarged scale and with further details of the compressed air source 120, a piston 124 is guided in a cylinder 130 and can be driven by means of a piston drive 132. By moving the piston 124 to the left (as shown in figure), the air volume 126 becomes smaller. By moving the piston 124 to the right, the air volume 126 becomes larger. Air can thus be forced from the compressed air source 120 through the pressure line 122 into the sealing member 114 (overpressure) or sucked from the sealing member into the compressed air source 120 (underpressure).

Figure 3:
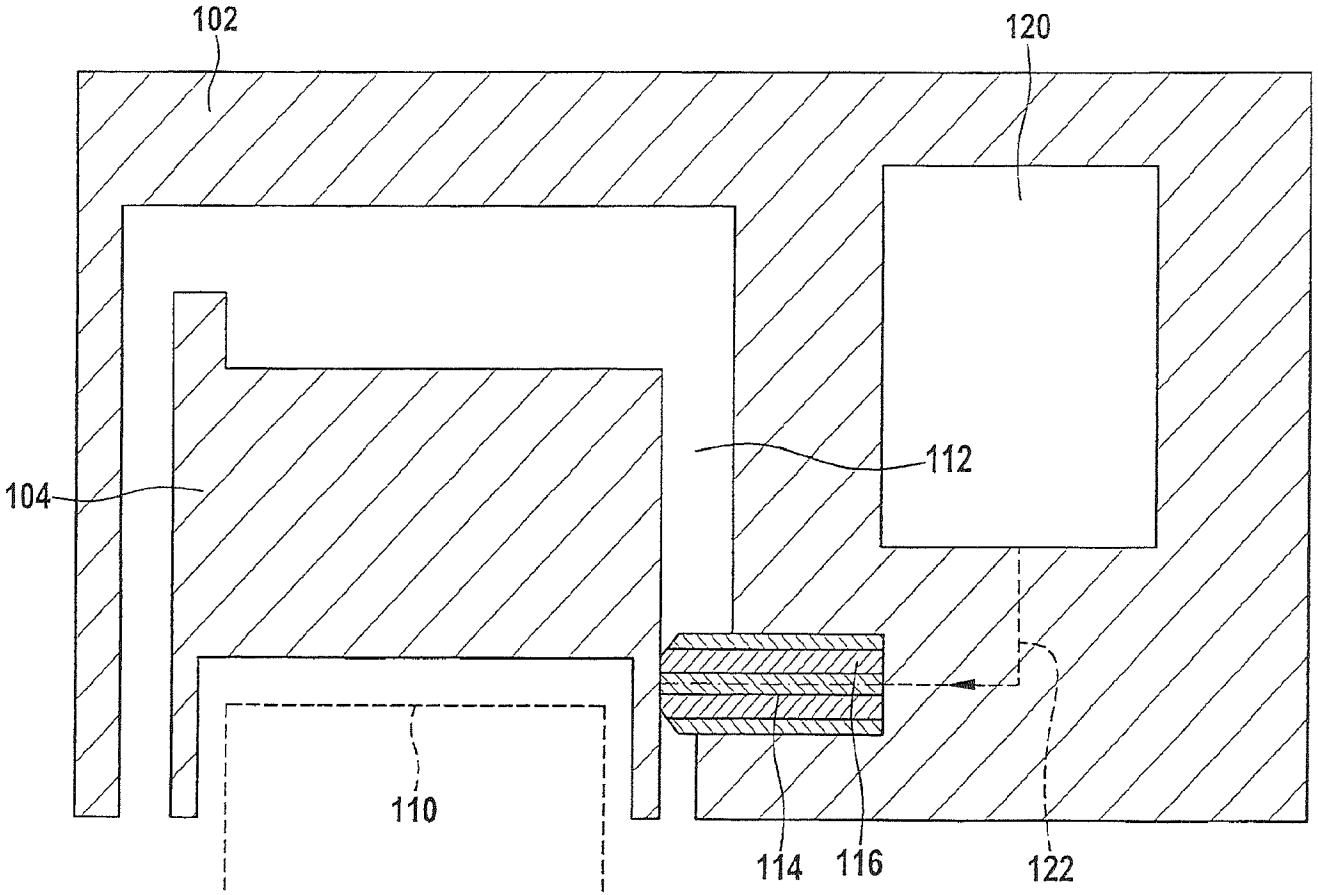
FIG. 3 schematically shows an enlarged view of the sectional plane A-A of FIG. 1.
Figure 4:
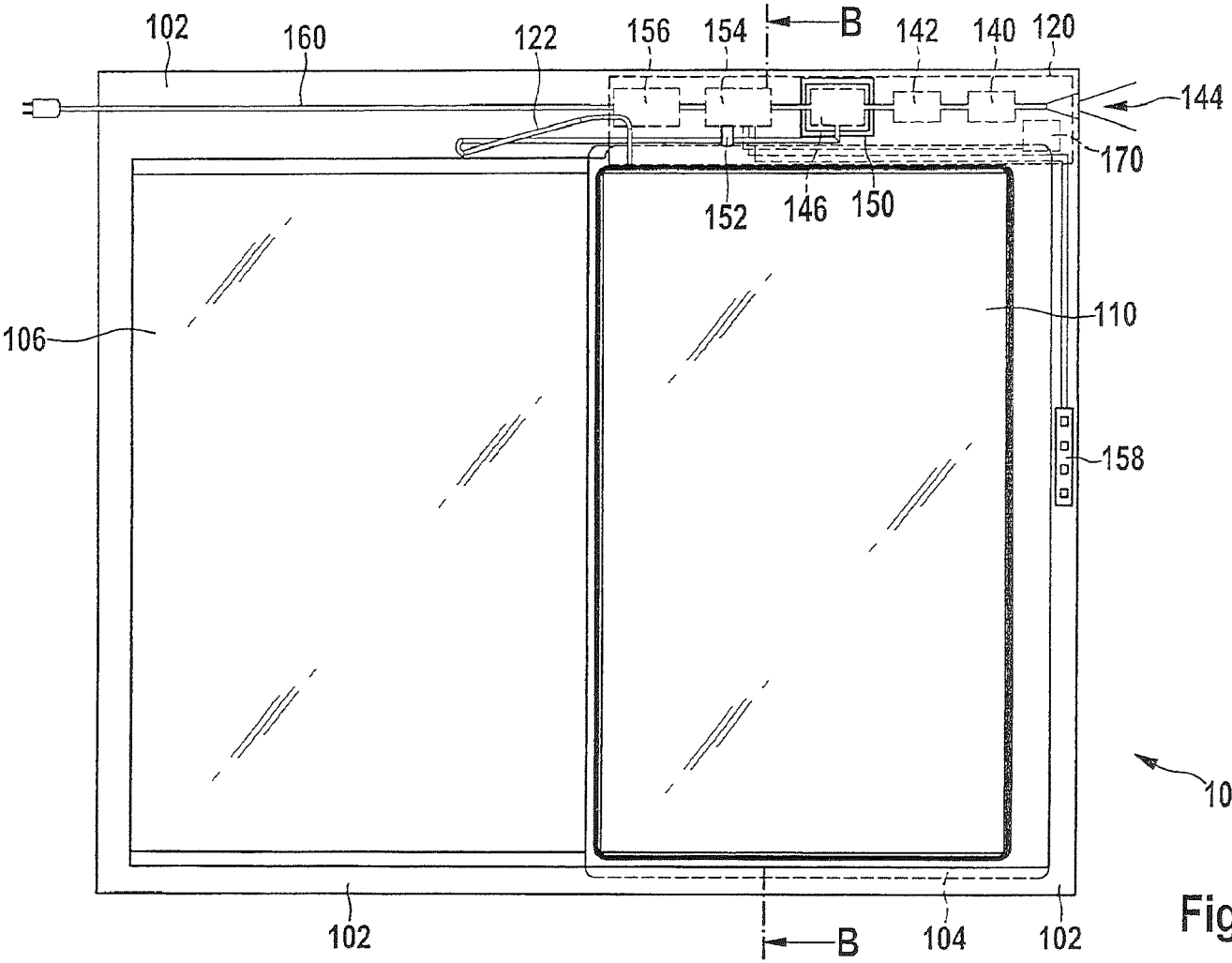
FIG. 4 is a front view of the device of the invention, in a second alternative embodiment.

Referring now to FIGS. 3 and 4, the frame 102 surrounds the outer edge of the leaf 104. A gap 112 is located between the facing surfaces of the frame 102 and leaf 104. The sealing member 114 is inserted in a cutout 116 of the frame 102, said sealing member being connected via the pressure line 122 to the compressed air source 120.

Figure 5A:
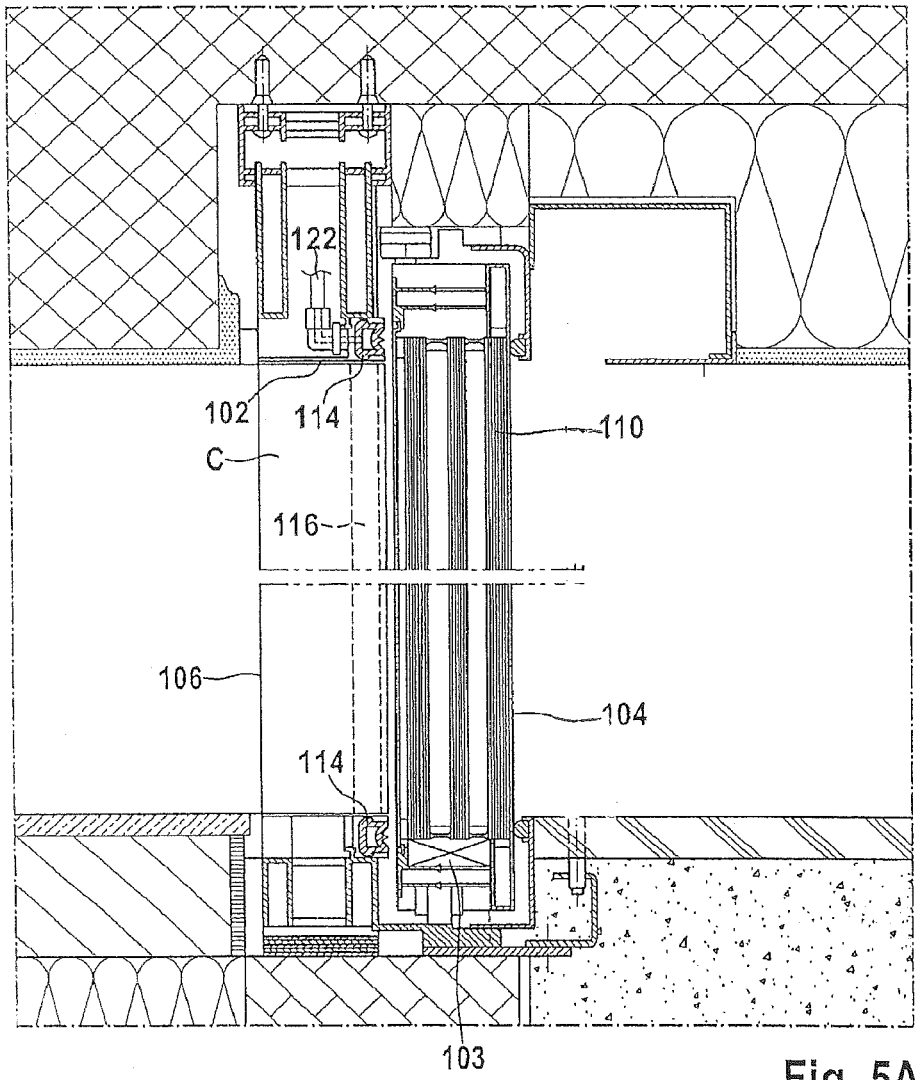
FIG. 5A is a cross sectional view of the device of the invention taken along lines B-B of FIG. 4.
Figure 5B:
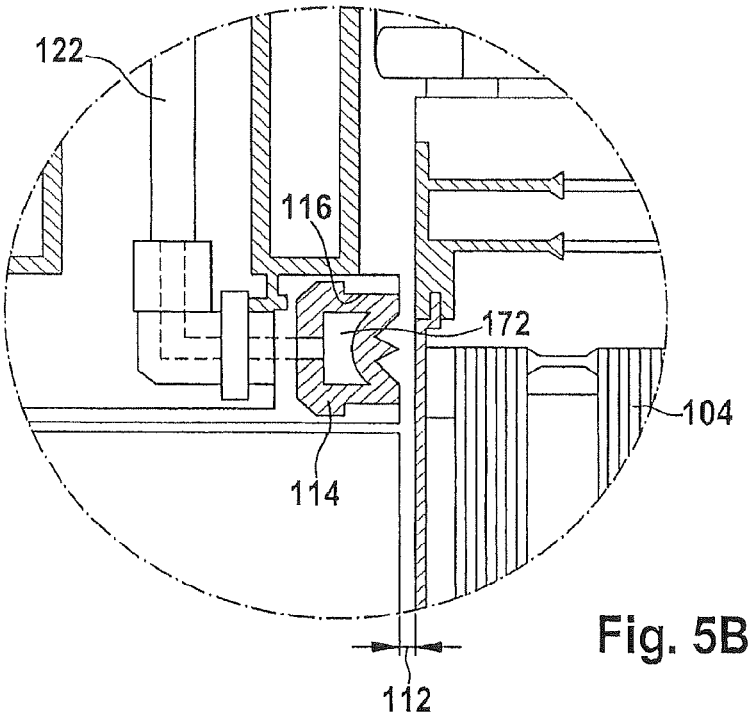
FIG. 5B is a close up view of detail C of FIG. 5A around the sealing member of the invention, showing the sealing member in a deflated, open condition.
Figure 5C:
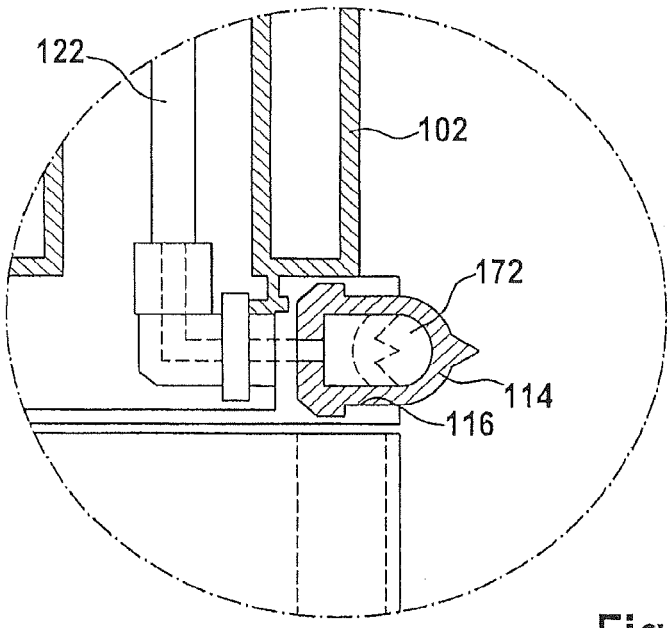
FIG. 5C is a close up view of area of detail C of FIG. 5A, showing the sealing member in an inflated, sealing condition (note leaf 104 is removed against which the sealing member would seal, for clarity).

Referring also to FIGS. 5A to 5C, in a preferred embodiment, an air filter 140 and air lubricator 142 is interposed between the air inlet 144 and the compressed air source 120. The compressed air source 120 is preferably a modular air compressor 146, such as part no. WOB-L series 8000, available from Gardner Denver, Inc. of Quincy, Ill., USA. The compressor 146 is preferably housed in a sound filtering housing 150. Further, a pressure or load sensor 152 senses when the compressed air source 120 has pressurized the sealing member 114 sufficiently to generate the desired sealing.

In another embodiment, as is common for use of pneumatic power tools, the fluid used in the device 100 is air in which an air lubricant such as "TELLUS 22", "DUCKHAMS", "ZIRCON 32", or "CASTROL AWS32" is mixed with the air in the lubricator 142 to better lubricate the compressor 146 integrated in the frame 102. Still further, a combination filter-lubricator can optionally be installed in the system and may be an integrated component of a suitable, off-the-shelf compressor 146.

In another embodiment, the pressure sensor 152 which senses when there is insufficient pressure in the inflatable seal 114 when the device 100 is in a sealing position, and then both restarts the compressor 146 to reseal the seal and sends an error signal to the CPU controller 154, indicating that there is there may be a leak. The CPU controller 154 and the compressor 146 are powered by an associated power supply 156 which, when the power supply is not a battery, connects to local electrical lines in the building. A control panel 158 is attached to the frame 102 or the leaf 104 and allows a user to seal and unseal the device 100, and in automated versions, to open and close the leaf 104 with mechanical, electric or pneumatic assist. This electrical connection 160 is the only power interface that must be made with the building, thus providing an almost "plug-and-play" installation (apart from, of course, the fitting of the hardware into the room opening which in any case requires considerable effort).

The object of the invention is to provide a device 100 for closing a room opening which functions as independently as possible and which can be installed with little assembly complexity in the reveal of the room opening. This object is achieved according to the invention in that a sealing member actuation device 120 is arranged in the frame 102 and/or in the leaf 104, by means of which the sealing member can be deformed and/or moved.

This allows a decentralized actuation of a sealing member 114 of each device 100. The sealing member 114 in a device 100 is thus in each case is associated with its own sealing member actuation device 120.

In an advantage of the invention, all the elements required for opening and closing the room opening are present in the device 100 according to the invention and are functionally connected to one another. They therefore do not need to be installed separately and then subsequently connected to one another.

Preferably, the sealing member actuation device 120 is in a functional relationship with a triggering device 170 which is arranged in the frame 102 and/or in the leaf 104 and which can trigger the action of the actuation device 120. Preferably, the triggering device 170 triggers the action of the sealing member actuation device 120 when the leaf 104 is in a defined triggering position relative to the frame 102. Advantageously, the defined triggering position is the closed position of the leaf 104 relative to the frame 102. The sealing member 114 is thus not deformed and/or moved until the room opening is covered by the leaf 104 and only the gap 112 remains to be sealed. The principle according to the invention can be applied regardless of whether the leaf 104 is slidable, tiltable, and/or pivotable relative to the frame 102.

It is advantageous if the sealing member actuation device 120 is arranged in the frame 102. It is particularly advantageous if the triggering device 170 is also arranged in the frame 102. Then all the important functional elements of the device 100 according to the invention are arranged in the frame 102 and can be connected to one another in the factory, it being unimportant whether these connections are mechanical, electrical, optical or the like. Preferably, the sealing member 114 is also advantageously but not necessarily arranged on the frame 102. In one special embodiment, the sealing member 114 may either be an actively deformable and/or movable part or an immobile or passively deformable and/or movable part. In this case, it is advantageous if the actively deformable and/or movable part of the sealing member 114 is arranged on the frame 102 so that the immobile or passively deformable and/or movable sealing (via, for example, a standard seal) is arranged in or on the leaf 104. Preferably, all seals extend along the circumference of all gaps (gap 112 included) that may exist between the frame 102 and the leaf 104. As a result, efficient, essentially 100% sealing can be achieved.

Referring now to FIGS. 5B and 5C, as for the actively deformable and/or movable sealing member 114, preference is given to a sealing member in the form of a hollow profile or tube, the cavity 172 of which contains a fluid (i.e., liquid or gas) which can be pressurized (as shown in FIG. 5C). By increasing the pressure, the sealing member 114 is widened, so that it completely fills the gap 112 that exists in the closed position. In this case, the sealing member actuation device 120 used may be a pressure source which is in fluid communication (i.e., there exists a liquid or gas connection path) with the cavity 172 of the sealing member 114 and can pressurize the fluid. In a hydraulic variant, the fluid used is a liquid or a liquid mixture and in particular water or oil. In a pneumatic variant, the fluid used is a gas or a gas mixture and in particular air. In this case, the sealing member 114 and the sealing member actuation device 120 are parts of a closed fluid volume.

If the closed fluid volume is a gas volume (pneumatic variant), the gas volume preferably contains a desiccant, optionally introduced with the lubricator 142. As a result, the formation of condensation in the gas volume is prevented, thereby preventing any impairment of the material of the sealing member 114 (damage to the elastomer) or impairment of the gas flow (freezing of lines). It is particularly practical if the pressure source 146 and the desiccant are arranged together in a module 120 which can be inserted in the frame 102 at the factory prior to installation on site (construction site).

Preferably, the sealing member actuation device 120 contains an electromagnetic actuator which can be controlled by an electric current and which may comprise for example a permanent magnet and a coil through which a current can flow, wherein the coil is connected to a special mechanical element. Preferably, the pressure source 146 comprises a piston 124 or a membrane which can be electromagnetically displaced or deformed in order to vary the pressure in the fluid volume.

The sealing member actuation device 120 may be connected to the power supply 156 via electrical lines 160 in the frame 102. As an alternative or in addition, the sealing member actuation device 120 may be connected, in a known manner, to a battery (not shown) in the frame 102. By virtue of such an electric "island" variant, there is no need to connect the frame 102 to a local power supply network, as a result of which the installation of the device according to the invention is facilitated. Preferably, a part of the outer surface of the frame 102 which is exposed to sunlight is equipped with solar cells (not shown) which charge the battery.

The triggering device 170 is preferably a switch arranged in the frame 102, which can be switched on or off by the movable leaf 104. If the leaf 104 is pivotably arranged relative to the frame 102, the switch used may be a pressure switch. If the leaf 104 is slidably arranged relative to the frame 102, the switch used may be a pressure switch with an angled surface ("ramp"). When the leaf 104 is pivoted or slid into the closed position relative to the frame 102, both types of switch are pushed in by the moving leaf 104, as a result of which the sealing member actuation device 120 becomes active. As an alternative or in addition, a light sensor or barrier (i.e., a light beam which emits a signal when the light beam is broken or re-established) may be provided which detects the closed position of the leaf 104 and sets the sealing member actuation device 120 into action as a result.

In a primary advantage, the device 100 of the invention provides a fluid-assisted sealing system that itself generates no frictional resistance whatsoever when an opening sealed therewith is being opened and shut and is essentially 100% weatherproof (i.e., an air and water-tight seal is generated) once activated.

In another advantage, the device 100 is safe in that failure of the device (e.g., a leak in the fluid system therein) causes unsealing of the glazing system which ensures that a user can open a leaf or door fitted with the device in the event of failure.

The specification and figures are to be considered in an illustrative manner, rather than a restrictive one and all modifications described herein are intended to be included within the scope of the invention claimed, even if such is not specifically claimed at the filing of the application. Accordingly, the scope of the invention should be determined by the claims appended hereto or later amended or added, and their legal equivalents rather than by merely the examples described above. For instance, steps recited in any method or process claims may be executed in any order and are not limited to the specific order presented in any claim. Further, the elements and/or components recited in any apparatus claims may be assembled or otherwise operationally configured in a variety of permutations to produce substantially the same result as the present invention. Consequently, the invention is not limited to the specific configuration recited in the claims.

Benefits, other advantages and solutions mentioned herein are not to be construed as critical, required or essential features or components of any or all the claims.

As used herein, the terms "comprises", "comprising", or any variation thereof, are intended to refer to a non-exclusive listing of elements, such that any process, method, article, composition or apparatus of the invention that comprises a list of elements does not include only those elements recited, but may also include other elements described in this specification. The use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or otherwise adapted by the skilled artisan to other design without departing from the general principles of the invention.

The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Multiple variations and modifications are possible in the embodiments of the invention described here. Although certain illustrative embodiments of the invention have been shown and described here, a wide range of modifications, changes, and substitutions is contemplated in the foregoing disclosure. While the above description contains many specifics, these should not be construed as limitations on the scope of the invention, but rather as exemplifications of one or another preferred embodiment thereof. In some instances, some features of the present invention may be employed without a corresponding use of the other features. Accordingly, it is appropriate that the foregoing description be construed broadly and understood as being given by way of illustration and example only, the spirit and scope of the invention being limited only by the claims which ultimately issue in this application.

The invention claimed is:

1. A device for closing a room opening, the device comprising a frame, at least one leaf, an inflatable sealing member and a sealing member actuation device in fluid communication with the sealing member, the frame being adapted to be set in a reveal of the room opening, the at least one leaf being movably arranged relative to the frame so as to move relative to the frame from an open to a closed position in which there exists between the frame and the at least one leaf a gap, the sealing member being disposed at least substantially within the gap, wherein:

the sealing member, when not actuated, does not drag against an adjacent component of a facing surface of the at least one leaf or the frame which is moving relative thereto when the room opening is opened or closed, the sealing member is actuated by the actuation device when the device for closing a room opening is in a position suitable for actuation of the sealing member, the sealing member actuation device comprises an electrically operated compressed air source arranged inside a leg of the frame, thereby permitting installation of said device for closing a room opening in a building without a need for a pre-existing external fluid pressure source, the at least one leaf is slidable relative to the frame, a control panel, operatively connected to the actuation device, is attached to the frame allowing sealing and unsealing of the device for closing a room opening, and the sealing member extends along the entire gap between the leaf and the frame.

2. The device according to claim 1, further comprising a triggering device which is arranged in at least one leg of the frame and which is adapted to operate the actuation device to seal the room opening when at least one of the frame and the at least one leaf is in a desired position.

3. The device according to claim 2, wherein the triggering device operates the actuation device when the at least one leaf is in a defined triggering position relative to the frame.

4. The device according to claim 3, wherein the defined triggering position is the closed position of the at least one leaf relative to the frame.

5. The device according to claim 2, wherein the triggering device is a switch which is switched on or off by the at least one leaf.

6. The device according to claim 1, wherein the sealing member is a hollow profile or tube which said compressed air source may selectively pressurize.

7. The device according to claim 1, wherein the compressed air source and a desiccant are arranged together in the sealing member actuation device which is inserted in the frame.

8. The device according to claim 1, wherein the compressed air source includes a pressure source comprises a piston or a membrane which can be at least one of electromagnetically displaced and deformed in order to vary the pressure in the sealing member.

9. The device according to claim 1, wherein the sealing member actuation device is connected to a power supply network via electrical lines in the frame.

10. The device according to claim 1, wherein the sealing member actuation device is connected to a battery in the frame.

* * * * *